US005685828A

United States Patent [19]

Dyck

[11] Patent Number: 5,685,828

[45] Date of Patent: Nov. 11, 1997

[54] COMBINATION FOOT RELAXER ROLLER AND STOOL

[76] Inventor: Cornelius M. Dyck, 4410 E. 42nd Ave., Spokane, Wash. 99223

[21] Appl. No.: 547,138

[22] Filed: Oct. 24, 1995

[51] Int. Cl.[6] ..... A61H 15/00; A47G 16/02

[52] U.S. Cl. ..... 601/112; 601/115; 601/121; 297/423.41

[58] Field of Search ..... 601/32, 112, 114, 601/115, 118, 119, 120, 121, 122, 123, 126, 127; 297/423.39, 423.41; D24/212, 213

[56] References Cited

U.S. PATENT DOCUMENTS

| | | | |
|---|---|---|---|
| D. 197,452 | 2/1964 | Correll | 297/423.41 |
| 243,557 | 3/1881 | Kientz | D83/15 |
| 274,649 | 7/1883 | Shiu | D24/36 |
| 346,450 | 4/1886 | Bruno | D24/212 |
| 2,804,122 | 8/1957 | Baum | 297/233 |
| 4,109,649 | 8/1978 | Iyomasa | 128/57 |
| 4,378,007 | 3/1983 | Kachadourian | 128/57 |
| 5,143,056 | 9/1992 | Yih-Jong | 601/118 |
| 5,411,470 | 5/1995 | Liptak | 601/118 |
| 5,597,199 | 1/1997 | Hoffman et al. | 297/423.41 X |

FOREIGN PATENT DOCUMENTS

| | | | |
|---|---|---|---|
| 2230706 | 10/1990 | United Kingdom | 601/122 |

*Primary Examiner*—Danton D. DeMille

[57] ABSTRACT

The invention is a combination foot relaxer and foot stool. The foot stool is a box like structure with top and bottom panels that over hang the sides of the box. Top and bottom panels are covered with material that is comfortable on the top and movement resistant on the bottom. The sides of the box separate into a top and bottom configuration hinged at one side and latched at an opposed side. When the box is opened a roller is uncovered. The roller is mounted on a shaft an supported by two plates, one on each side. The plates are attached to the bottom panel. The roller is covered with a hard surface rope that is wound across the surface of the roller. The user will sit in a chair and relax his feet by stroking them on the roller. In an alternative embodiment two smaller rollers are utilized in place of one large one.

12 Claims, 2 Drawing Sheets

COMBINATION FOOT RELAXER ROLLER AND STOOL

BACKGROUND OF THE INVENTION

1. Field of the Invention

This invention relates generally to devices for relaxing muscles and parts of the body and more specifically to a device for relaxing the soles of the feet.

2. Description of the Relevant Prior Art

Although it appears to be a passing American custom, the idea of a person working on his feet for eight or more hours a day then arriving at home to relax by sitting in his favorite chair and placing his feet on an elevated foot stool, still exists. Although the nature of the work has in many instances changed from factory/warehouse to service industry, the challenge to relax the worker and prepare him for the next days endeavor continues to be a subject of interest to inventors.

Apparatus for massaging the feet are disclose in U.S. Patents including: U.S. Des. Pat. No. 243,557 issued Mar. 1, 1977 to Kientz which shows a foot massage roller of undulating shape suspended in a supporting structure; U.S. Pat. No. 4,109,649 issued Aug. 29, 1978 to Iyomasa discloses a foot massager which consists of a single plastic element shaped into a longitudinal inner cylinder having rows of projections and wheel like ends so that the cylinder can be rolled about the floor with the foot and massaged; U.S. Pat. No. 4,378,007 issued Mar. 29, 1983 to Kachadourian for a massaging device that is generally cylindrical, includes projection and rolls on the floor, the invention includes projections on the end for massaging other parts of the body; U.S. Des. Pat. No. Des. 274,649 issued Jul. 10, 1984 to Shiu for a foot massage roller, the invention shows a series of connected rings connected to a larger ring on each end giving the appearance of being able to roll on the floor and propelled by the foot; U.S. Des. Pat. No. Des. 346,450 issued Apr. 26, 1994 to Bruno for a foot massage roller device and appears to show a plurality of rollers with projections supported by a frame, it appears that the user stands on the rollers, and U.S. Pat. No. 5,411,470 issued May 2, 1995 to Liptak et al. who disclose a foot massager of the types known in the art of a cylindrical shape, including enlarged rollers on the ends for rolling on a floor and bumps to massage the foot, the device is adapted to mate with a pair of supports connected to a wall or floor and rotate in the supports.

The prior art, taken alone or in combination, fails to anticipate this invention. The instant invention as disclosed and claimed herein provides distinct and useful advantages not previously known to the prior art.

SUMMARY OF THE INVENTION

The invention is a combination foot stool and foot relaxer roller. The foot stool is quadrilateral in shape having four sides, a top and a bottom. The top and bottom surfaces are covered with a material having a relatively high coefficient of friction such as a wool or cotton carpet. The top and bottom panels over hang the side walls which are each formed in two sections, one, affixed to the bottom panel which is significantly smaller in a height dimension than section two which is attached to the top panel. The two sections of one side are hinged and the two sections of the opposed side are latchable. The combination comprises essentially an inverted box with a cover on the bottom. Within the foot stool is a single roller of wood or other suitable material having an axial shaft suspended between two mounting brackets affixed to the bottom panel. In an alternative form the foot stool contains a pair of rollers mounted adjacent to each other and attached to the bottom panel. The rollers, single or double are covered with a spirally wound, large diameter hard surface rope. The material of the rope is not as important as the hard surface, hemp and nylon rope at least meet this requirement.

The invention is covered with a material that will provide comfort to the user when used as a foot stool and material that will reduce movement when used as a foot relaxer. The force applied to the roller by the user in the sitting position is, in the normal case, insufficient to cause translational movement of the foot stool.

In operation, the user opens the foot stool and after removing his shoes and socks, sits in a chair and rolls his feet against either one or two rollers dependent upon which embodiment is used, until the circulation returns to normal and the feet become relaxed. When finished, the foot stool is closed and returns to its primary function of foot support.

It is therefore an object of the invention to provide a new and improved foot relaxer and stool.

It is another object of the invention to provide a new and improved foot relaxer and stool that is simple and easy to use.

It is a further object of the invention to provide a new and improved foot relaxer and stool that has all the advantages of like prior art devices and none of the disadvantages.

It is still another object of the invention to provide a new and improved foot relaxer and stool which allows the user to relax the feet while in the seated position.

It is still a further object of the invention to provide a new and improved foot relaxer and stool which may be easily and efficiently manufactured and marketed.

It is another object of the invention to provide a new and improved foot relaxer and stool which is of a durable and reliable construction.

These, together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF A PREFERRED EMBODIMENT

Figure 1:
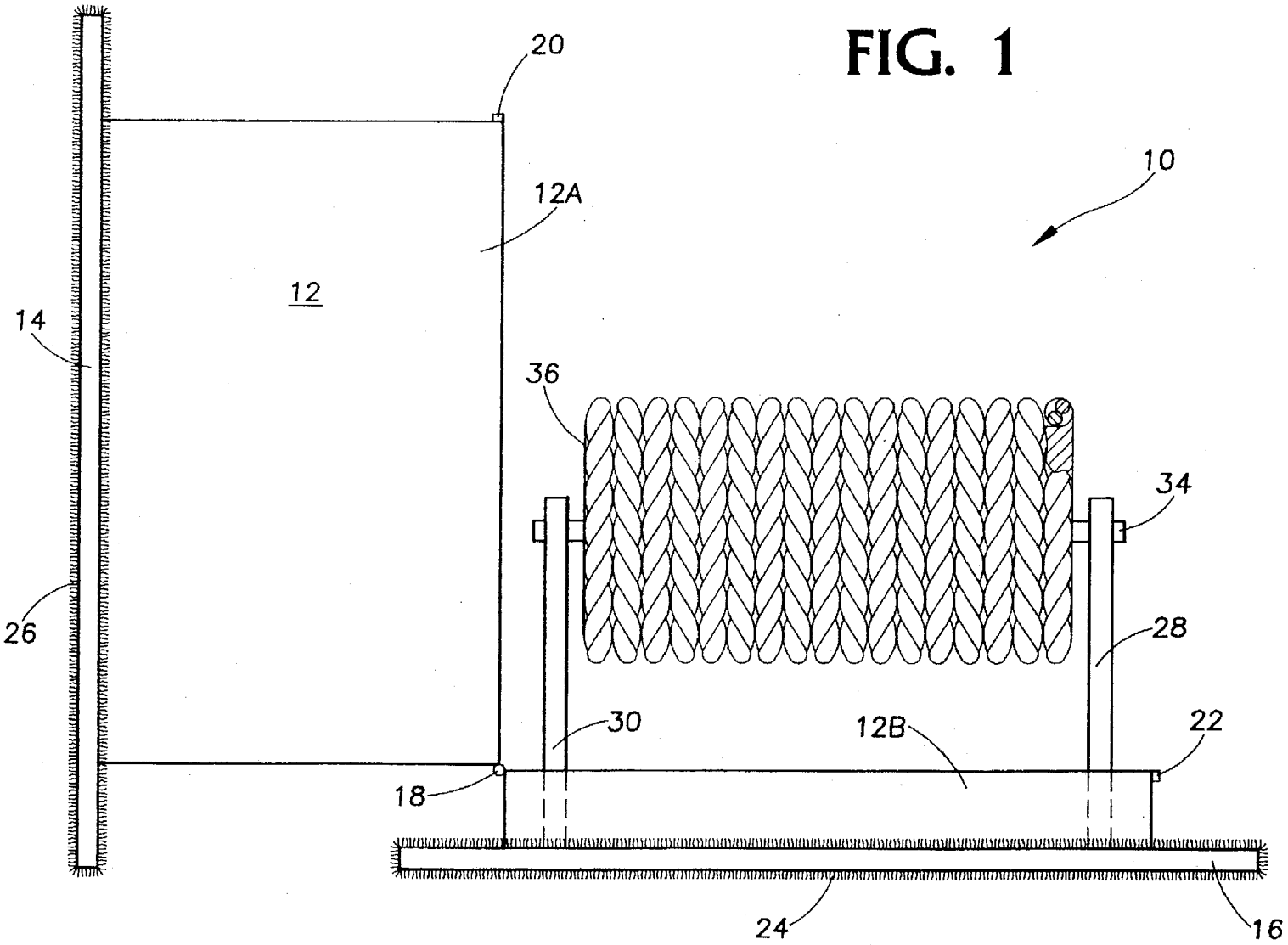
FIG. 1 is an environmental view of the invention with the foot stool open.
Figure 3:
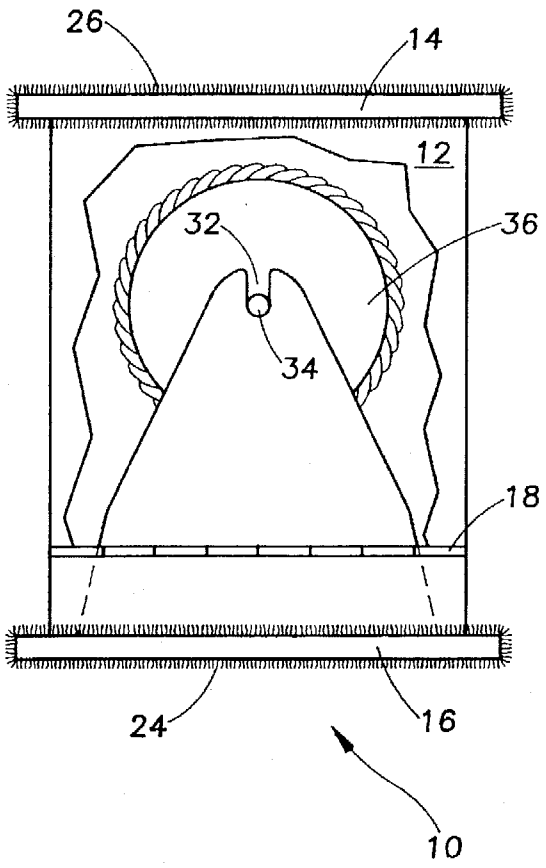
FIG. 3 is a side elevation view of the invention partly cut away for clarity.
Figure 2:
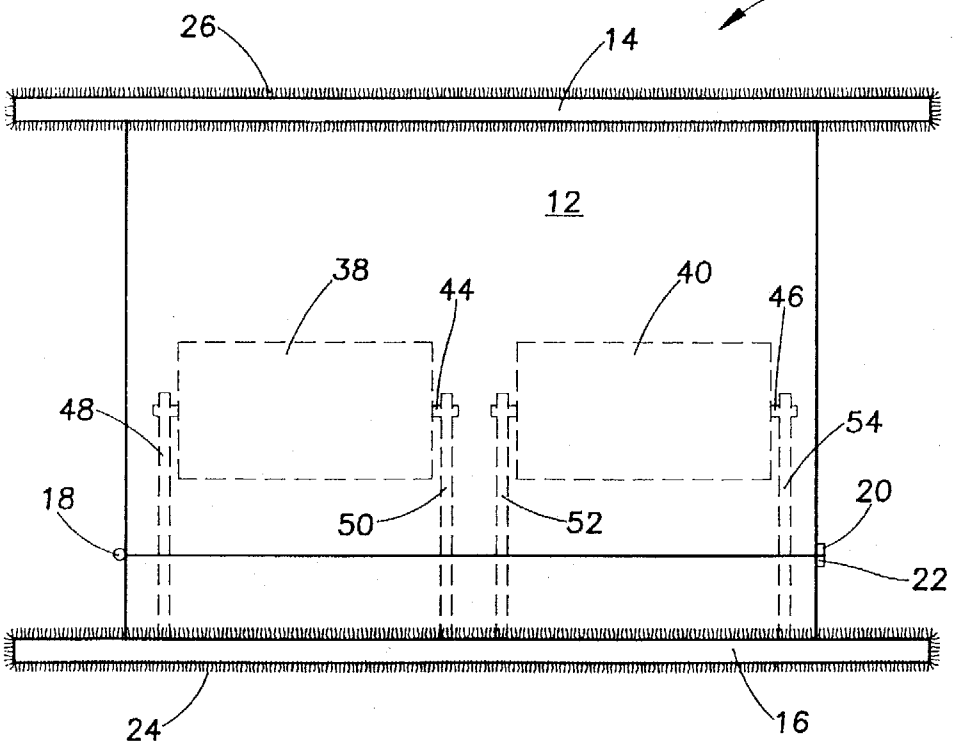
FIG. 2 is view of an alternative embodiment of the invention with the foot stool closed.

Referring now to FIGS. 1, 2, and 3, the invention is shown generally at 10 and consists of a quadrilateral enclosure having four sides 12, a top panel 14 and a bottom panel 16. Each side is divided into two sections a large first section 12A and a small second section 12B. The top panel 14 is affixed to section 12A, while the bottom panel is affixed to section 12B. The top panel 14 along with the sides 12A are connected to the bottom panel 16 and sides 12B by a hinge 18 located along one edge. The opposed edge contains a latch 20,22 which locks the top and bottom of the stool in place.

The top panel 14 of the stool is covered with a material 26 that is long wearing an suitable for a foot rest. One material could be a carpet material although other materials would work equally as well. Likewise the bottom panel 16 of the stool is covered with a material 24 having a relatively high coefficient of friction such as wool or cotton carpet although other materials would word equally as well. The purpose being to restrict the translational movement of the stool. Affixed to the bottom panel 16 by suitable fasteners, and within the area bounded by the sides of the enclosure, are a pair of generally triangular shaped supports 28 and 30. The apex of each support includes a slot 32 adapted to receive an axle shaft 34. Mounted over shaft 34 is a roller 36, formed of wood, plastic or other suitable material. The roller is covered with a large diameter, hard rope, fastened and wound from one side to the opposed side where it is fastened. Rope such as hemp and nylon would be suitable as well as other hard covered rope.

An alternative embodiment is shown in FIG. 2 where two rollers 38,40 are wound with rope, mounted on axle shafts 42,44 and supported at 48,50,52,54 in the same manner as the roller described with regard to FIG. 1. The alternative embodiment includes rollers that are the same as the principle embodiment but smaller in that the intent is to use one roller to relax each foot independent of the other.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. An article of furniture comprising in combination a foot stool and foot relaxer consisting of:

an enclosure having four sides, a top panel and a bottom panel, where each side is formed in two sections;

means for connecting the sections of two opposed sides, thereby allowing the each section to move toward and away from the other in a controlled manner;

means covering the bottom panel having a surface resistive to relative translational movement;

means covering the top panel having a surface consistent with foot comfort;

means within the enclosure, attached to the bottom panel for relaxing a foot comprising, a pair of spaced parallel mounting supports, a shaft removably mounted between the supports, a roller rotatably mounted on the shaft, a rope wound around the roller and connected at each end to the roller, whereby application of foot pressure to the roller will allow the rope surface to relax the foot.

2. An article of furniture according to claim 1 wherein: the means for connecting two sections on one side is a hinge.

3. An article of furniture according to claim 2 wherein: the means for connecting two sections one a side opposed to the hinge is a latch securing apparatus.

4. An article of furniture according to claim 3 wherein: the means covering the bottom panel is a carpet material.

5. An article of furniture according to claim 4 wherein: the mounting supports are generally triangularly shaped and contain a shaft receiving slot at their apex.

6. An article of furniture according to claim 5 wherein: the shaft is steel.

7. An article of furniture according to claim 6 wherein: the roller is formed of wood.

8. An article of furniture according to claim 6 wherein: the roller is formed of a polymeric material.

9. An article of furniture according to claim 7 wherein: the rope is hemp.

10. An article of furniture according to claim 7 wherein: the rope is nylon.

11. An article of furniture according to claim 7 including: a plurality of rollers.

12. An article of furniture according to claim 11 wherein: the plurality of rollers includes two.

* * * * *